US009919437B2

(12) United States Patent
Veltman et al.

(10) Patent No.: US 9,919,437 B2
(45) Date of Patent: Mar. 20, 2018

(54) PERSONAL CARE DEVICE

(71) Applicant: KONINKLIJKE PHILIPS N.V., Eindhoven (NL)

(72) Inventors: Eddy Gerrit Veltman, Eindhoven (NL); Hedzer Durksz, Eindhoven (NL); Matthijs Jaap Wolter Ten Hove, Eindhoven (NL); Liesbet Hillechina Wind, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/428,994

(22) PCT Filed: Oct. 27, 2014

(86) PCT No.: PCT/EP2014/072931
§ 371 (c)(1),
(2) Date: Mar. 18, 2015

(87) PCT Pub. No.: WO2015/025064
PCT Pub. Date: Feb. 26, 2015

(65) Prior Publication Data

US 2016/0236360 A1 Aug. 18, 2016

(30) Foreign Application Priority Data

Nov. 5, 2013 (EP) ..... 13191490

(51) Int. Cl.
*B26B 19/14* (2006.01)
*B26B 19/30* (2006.01)
*B26B 19/38* (2006.01)

(52) U.S. Cl.
CPC ..... *B26B 19/388* (2013.01); *B26B 19/146* (2013.01)

(58) Field of Classification Search
CPC . B26B 19/388; B26B 19/146; B26B 19/3813; B26B 21/40
(Continued)

(56) References Cited

U.S. PATENT DOCUMENTS 5,007,168 A * 4/1991 Messinger ..... B26B 19/146 30/41.5
5,687,481 A * 11/1997 De Boer ..... B26B 19/14 30/43.1
(Continued)

FOREIGN PATENT DOCUMENTS

DE 19601780 C1 6/1997
EP 0721826 A2 11/1995
(Continued)

*Primary Examiner* — Ghassem Alie
*Assistant Examiner* — Bharat C Patel

(57) ABSTRACT

A personal care device comprising a main housing, a hair-cutting module displaceable with respect to the main housing against spring force in a direction parallel to a main axis, and a sensor comprising a first sensor unit connected to the main housing and a second sensor unit connected to the hair-cutting module. The hair cutting module is also tiltable in directions relative to the main housing. By measuring average displacement of the hair cutting module at multiple locations, the sensor is sensitive only to displacement parallel to the main axis. The sensor measures such displacement and determines the force needed to effect such displacement. If the force is larger than a predetermined value, a warning signal will be produced.

13 Claims, 16 Drawing Sheets

(58) Field of Classification Search
USPC ..... 30/43.6–46, 298
See application file for complete search history.

(56) References Cited

U.S. PATENT DOCUMENTS 5,704,126 A * 1/1998 Franke ..... B26B 19/046 30/34.1
5,983,502 A * 11/1999 Geertsma ..... B26B 19/14 30/43
6,009,623 A * 1/2000 Orloff ..... B26B 21/4056 30/41.7
6,722,038 B2 * 4/2004 Visman ..... B26B 19/14 30/43.6
7,222,428 B2 * 5/2007 Koike ..... B26B 19/145 30/346.51
7,743,508 B2 * 6/2010 Shimizu ..... B26B 19/145 30/346.51
8,220,157 B2 * 7/2012 Shimizu ..... B26B 19/145 30/43.4
8,261,452 B2 * 9/2012 Westerhof ..... B26B 19/14 30/43.4
8,393,082 B2 * 3/2013 Shimizu ..... B26B 19/14 30/43.5
8,627,573 B2 * 1/2014 Kraus ..... B26B 19/10 30/527
9,386,843 B2 * 7/2016 Grez ..... A46B 13/008
2004/0098862 A1 * 5/2004 Orloff ..... B26B 21/222 30/41.7
2007/0124936 A1 * 6/2007 Okabe ..... B26B 19/14 30/43.6
2007/0256302 A1 * 11/2007 Okabe ..... B26B 19/141 30/43.6
2007/0277379 A1 * 12/2007 Okabe ..... B26B 19/14 30/43.92
2008/0034591 A1 * 2/2008 Fung ..... B26B 19/02 30/43.92
2008/0092393 A1 * 4/2008 Van Der Meer ..... B26B 19/146 30/43.6
2008/0294176 A1 * 11/2008 Hashiguchi ..... A45D 26/0028 606/133
2008/0313910 A1 * 12/2008 Walls ..... B26B 19/14 30/34.2
2009/0000126 A1 * 1/2009 Kraus ..... B26B 19/046 30/34.1
2010/0011589 A1 * 1/2010 Van Der Borst ..... B26B 19/14 30/43.4
2010/0018058 A1 * 1/2010 Brada ..... B26B 19/14 30/43.6
2010/0275446 A1 * 11/2010 Schmitt ..... B26B 19/14 30/43.4
2011/0308088 A1 * 12/2011 Brada ..... B26B 19/14 30/43.6
2012/0159795 A1 * 6/2012 Walmsley ..... B26B 19/3853 30/526

FOREIGN PATENT DOCUMENTS

WO 9532843 A1 12/1995
WO 2008010139 A1 1/2008
WO 2011055323 A1 5/2011

* cited by examiner

PERSONAL CARE DEVICE

This application is the U.S. National Phase application under 35 U.S.C. § 371 of International Application No. PCT/EP2014/072931, filed on Oct. 27, 2014, which claims the benefit of European Application No. 13191490.5 filed on Nov. 5, 2013. These applications are hereby incorporated by reference herein.

FIELD OF THE INVENTION

The invention relates to a personal care device comprising a main housing, a hair-cutting module being displaceable with respect to the main housing against spring force in a direction parallel to a main axis, and a sensor comprising a first sensor unit connected to the main housing and a second sensor unit connected to the hair-cutting module, said sensor being arranged and configured to measure a displacement of the second sensor unit with respect to the first sensor unit in a direction parallel to the main axis.

BACKGROUND OF THE INVENTION

U.S. Pat. No. 5,983,502A discloses a shaving apparatus with a main housing and three hair-cutting units. Each hair-cutting unit comprises an external hair-cutting member with hair entry apertures and an internal hair-cutting member, which is rotationally drivable with respect to the external hair-cutting member by means of a coupling pin. The coupling pin is rotatable about a main axis and is axially movable against the force of the spring in a direction parallel to the main axis.

During shaving, a user will try to avoid skin irritation and skin injury as much as possible. Skin irritation and injury occur when the hair-cutting member comes into contact with the skin too intensively, which occurs particularly when the user presses the hair-cutting member against the skin with excessive force. This can occur during use of wet-shavers as well as electric dry-shavers, and particularly when a user switches from one system to the other or in case of an inexperienced user. In the initial period of use, it is important that the user does not press the shaving apparatus against the skin with excessive force.

The shaving apparatus disclosed in U.S. Pat. No. 5,983,502A comprises a sensor means for warning the user when a given preset force between the external hair-cutting member and the main housing is exceeded during shaving. The sensor comprises an annular permanent magnet, which is secured to the coupling pin, and a Hall-sensor, which is disposed underneath the magnet and which is secured in the main housing.

There is a direct relationship between the force with which the cutting unit is depressed (spring force) relative to the main housing and the distance between the magnet and the Hall-sensor. The distance between the magnet and the sensor decreases as the cutting unit is depressed further. The Hall-sensor is connected to an electronic circuit which has been adjusted in such a way that a warning signal is produced when a given distance, i.e. pressure, is exceeded. The shaving apparatus can produce an optical or acoustic warning signal when the pressure exceeds a given value and thus warns the user to reduce the pressure in order to preclude or stop skin irritation and injury.

The movements of the coupling pin are limited to a rotational movement about the main axis and axial movement along the main axis. Due to the annular shape of the magnet, a part of the magnet will always be located opposite the Hall-sensor, so that in each rotational position of the coupling pin and the internal hair-cutting member connected thereto, the distance between the Hall-sensor and the annular magnet can be measured.

Other movements of the hair-cutting member with respect to the main housing cannot be detected by the sensor, since it would not be possible to deduce from the measured change in distance between the Hall-sensor and the annular magnet whether the change in distance is due to an axial movement or, for example, a tilting movement about a tilt axis extending perpendicularly to the main axis.

SUMMARY OF THE INVENTION

In view of the above, a general object of the present invention is to provide a personal care device of the kind mentioned in the opening paragraph, wherein the axial displacement of the hair-cutting module can be correctly measured.

In order to achieve this object, the invention provides a personal care device of the kind mentioned in the opening paragraph, which is further characterized in that the hair-cutting module is tiltable with respect to the main housing, against spring force, about at least one tilt axis extending perpendicularly to the main axis, wherein the first sensor unit is arranged in at least a first and a second location relative to the main housing, and wherein the second sensor unit is arranged in at least a third and a fourth location relative to the hair-cutting module, adjacent to, respectively, the first and the second location seen in directions parallel to the main axis, a distance between the first and the second location being at least 25% of a distance between the first and the third location, and wherein during tilting of the hair-cutting module with respect to the main housing, a change in distance between the first and the third location is different from a change in distance between the second and the fourth location.

Preferably, the third and the fourth location are opposite, respectively, the first and the second location, seen in directions parallel to the main axis.

When the hair-cutting module is only being moved in a direction parallel to the main axis, the distance between each part of the first sensor unit and each part of the second sensor unit located opposite said part of the first sensor unit, and in particular the distances between the first and the third location and between the second and the fourth location, will equally decrease.

When the hair-cutting module is only being tilted about the tilt axis, the distances between the first and the third location and between the second and the fourth location will change differently. Based on the information obtained from the sensor units, for example information about the measured distances between the first and the third location and between the second and the fourth location and information about the mutual positions of the first, second, third and fourth location, the tilting angle of the hair-cutting module relative to the main housing can be calculated. Alternatively, it can be determined that the displacement of the hair-cutting module is only a tilting displacement.

When the hair-cutting module is being moved in a direction parallel to the main axis as well as being tilted about the tilt axis, it can be determined from the information obtained from the sensor units which part of the measured distances results from the axial displacement and which part of the measured distances results from the tilting displacement.

There is a direct relationship between the force by which the hair-cutting module is depressed against spring force relative to the main housing and the axial displacement. From the measured displacements and the known stiffness properties of the spring member providing the spring force, the normal pressure force on the skin can be calculated. If the axial displacement is larger than a predetermined value, a warning signal will be produced indicating that the pressure force on the skin is too high.

The personal care device may be a shaver, a trimmer, a grooming device or other kind of cutting device.

A distance needs to be present between the first and the second location, preferably larger than 25% of the distance between the first and the third location, in order for the tilt angle about the tilt axis to be determined with sufficient accuracy. The distance change between a pair of adjacent or opposite locations on the first and the second sensor unit can be determined between as many pairs of adjacent or opposite locations as desired.

In a further embodiment of a personal care device in accordance with the invention, with respect to a plane extending through the main axis and the tilt axis, the first and third location are located on a first side of said plane whilst the second and fourth location are partly located in said plane or on a second side of said plane.

When the hair-cutting module is being tilted about the tilt axis, the distance between the first and third location, both located on the first side of said plane, will be decreased whilst the distance between the second and fourth location, both located on the second side of said plane, will be increased, or vice versa. Based on the obtained information about the distance changes, the tilting angle can be calculated and/or it can be deduced that the displacement of the hair-cutting module is only a tilting displacement.

It is also possible that the second and fourth location are located in said plane. In this case, the effect of a tilting displacement will be that the distance between the second and fourth location located in the plane will remain constant, whilst the distance between the first and third location will increase or decrease.

In a further embodiment of a personal care device according to the invention, the hair-cutting module is tiltable with respect to the main housing about two tilt axes extending perpendicularly to each other.

The two tilt axis are located in a plane perpendicular to the main axis. The main axis can be considered as a Z-axis whist the two tilt axis can be considered as an X-axis and a Y-axis.

A tilting displacement about the X-axis as well as about the Y-axis can be seen as a combined tilting displacement about a main tilt axis, which main tilt axis is also located in the plane perpendicular to the main axis and encloses angles with the X-axis and the Y-axis. In an embodiment, the location of the sensor units is such that, with respect to a plane extending through the main axis and each possible main tilt axis, the first sensor unit as well as the second sensor unit are partly located on a first side of said plane and are partly located in said plane or on a second side of said plane.

In practice this means that, to ensure that for each tilting displacement about the X-axis and the Y-axis it will be possible to determine the axial displacement along the Z-axis from the measured distances between the first and the second sensor unit, it is preferable that at least at three different locations about the main axis the distances between the first and second sensor units are being measured or that the distances between the first and second sensor units change between at least three different adjacent or opposite locations on the first and second sensor units, wherein the average change in distances can be detected by the sensor.

In a further embodiment of a personal care device according to the invention, the first sensor unit and the second sensor unit are arranged symmetrically around the main axis.

Due to the symmetrical arrangement of the sensor units, the calculation of the axial displacement from the information obtained from the sensor units, such as the measured distances, is relatively easy.

In a further embodiment of a personal care device according to the invention, the hair-cutting module comprises a number of cutting units, each cutting unit being provided with an external cutting element and an internal cutting element being rotatable about a rotation axis with respect to the external cutting element, wherein the rotation axes of the cutting units are located symmetrically around the main axis and each enclose an angle between 0 degrees and 15 degrees with the main axis.

In such an embodiment, the hair-cutting module with the number of cutting units is movable along the main axis and tiltable about the tilt axis.

By measuring the axial displacement of the hair-cutting module resulting from the normal pressure force on the skin of the user, the user can be provided with feedback when the normal pressure force and thus the axial displacement is outside a preferred range that provides optimum cutting performance and skin comfort. The normal pressure force is the pressure force extending perpendicularly to the skin of the user. During normal use, the normal force extends parallel to the main axis.

Due to the location of the sensor units, the axial displacement can be determined independently of the tilting displacement of the hair-cutting module, which tilting displacement is for example caused by friction between the hair-cutting module and the skin when the hair-cutting module is moved over the skin surface.

In a further embodiment of a personal care device according to the invention, the hair-cutting module is connected to the main housing via a central shaft member which accommodates a main driving axle for commonly driving the internal cutting elements of the cutting units, wherein the sensor is arranged symmetrically around said main driving axle.

In this embodiment, the driving axle is centrally arranged in the central shaft member, and drives the individual internal cutting elements of the cutting units, for example, via gear wheels provided on individual driving spindles of the cutting units. The symmetrical arrangement of the sensor around the main driving axle provides a compact construction of the sensor and the personal care device.

In a further embodiment of a personal care device according to the invention, the first sensor unit or the second sensor unit comprises a ring-shaped coil and the other of the sensor units comprises a plate influencing a magnetic field of the ring-shaped coil by a displacement of the second sensor unit with respect to the first sensor unit in a direction parallel to the main axis.

The plate can be made of a metal, wherein the plate will act as a short-circuited coil with only one winding. The plate can also be made of an electrically isolating material which is provided with a short-circuited coil or it can be made of ferrite. Such a plate influences the magnetic field produced by the coil, and changes the inductance of the coil when the average distance between the coil and the plate alters due to an axial displacement. However, when in this embodiment the hair-cutting module tilts about the two tilt axes extending along the X-axis and Y-axis as a result of friction forces between the skin and the hair-cutting module, the measurement of the axial displacement and thus the normal force is not affected, because the tilting does not influence the average inductance of the coil since the average distance between the coil and the plate remains constant during such tilting.

The ring-shaped coil preferably extends perpendicularly to the main axis and symmetrically around the main axis. The plate preferably extends perpendicularly to the main axis.

In a further embodiment of a personal care device according to the invention, the first sensor unit or the second sensor unit comprises at least three Hall-sensor elements arranged at predetermined different locations around the main axis, and the other of the sensor units comprises at least three magnets, each magnet being arranged opposite a respective one of the Hall-sensor elements, seen in directions parallel to the main axis.

By having at least three Hall-sensor elements and cooperating magnets arranged at three different locations around the main axis, both the average axial displacement of the hair-cutting module with respect to the main housing as well as the tilting displacement about the two tilt axes extending along the X-axis and Y-axis can be detected by suitably combining the measurements of the at least three individual Hall-sensor elements. From the measured displacements and the known stiffness properties of the spring member providing the spring force, both the average normal pressure force applied to the hair-cutting module and the friction forces applied to the hair-cutting module in the X- and Y-directions when the hair-cutting module moves over the skin surface and causes tilting of the hair-cutting module relative to the main housing, can be determined.

In a further embodiment of a personal care device according to the invention, the Hall-sensor elements as well as the magnets are located at regular intervals around the main axis.

Due to the symmetrical arrangement of the Hall-sensor elements as well as the magnets, the calculation of the axial displacement of the hair-cutting module from the information obtained from the Hall-sensor elements is relatively easy.

In a further embodiment of a personal care device according to the invention, the hair cutting module comprises an intermediate part, which is provided with the second sensor unit, and a first hair cutting part, which is detachably connectable to the intermediate part, whilst the personal care device comprises a second hair cutting part which is different from the first hair cutting part, wherein by connecting the first hair cutting part to the intermediate part the second sensor unit is displaced into a reference position relative to the first sensor unit, or obtains a geometry or a material characteristic which is different from, respectively, a reference position, a geometry or a material characteristic obtained by connecting the second hair cutting part to the intermediate part.

The different hair cutting parts are preferably suitable for different kinds of hair treatment, such as shaving, trimming, or brushing. The personal care device can be used for these different kinds of hair treatment by connecting the desired hair cutting part to the intermediate part. For some kinds of hair treatment it is not necessary to detect the pressure forces applied to the hair-cutting module and to warn the user if the pressure forces are too high or too low. By displacing the second sensor unit, as a result of connecting the first hair cutting part, into a different reference position relative to the first sensor unit, or by providing the second sensor unit with a different geometry or a different material characteristic as compared to the reference position, the geometry or the material characteristic obtained as a result of connecting the second hair cutting part, it is possible to detect by means of the first and second sensor units which hair cutting part is being connected to the intermediate part. The reference position of the second sensor unit is the position of the second sensor unit when being connected to the intermediate part but without an external pressure force being applied to the hair cutting part, so without operating the personal care device.

The information about the kind of hair cutting part being connected to the intermediate part can be used to provide the user with information about the pressure forces, for example only when a specific hair cutting part is connected to the intermediate part.

In a further embodiment of a personal care device according to the invention, the second sensor unit is being displaced against spring force with respect to the intermediate part by connecting the first hair cutting part to the intermediate part.

By displacing the second sensor unit with respect to the intermediate part, the second sensor unit is being displaced into a reference position which differs from a reference position obtained when the second sensor unit is not being displaced with respect to the intermediate part. The distance between the reference positions of the second sensor unit, obtained by respectively connecting the first and the second hair cutting parts, is preferably larger than the distance over which the second sensor unit will be moved during operation of the personal care device, so that the operating windows of the sensor associated with the different hair cutting parts will not overlap.

In a further embodiment of a personal care device according to the invention, the first hair cutting part is a hair shaving part, whilst the second hair cutting part is a hair trimming or brushing part.

If the first hair cutting part is a hair shaving part, it is important to detect the pressure forces applied to the skin of a user and to warn a user when necessary, whilst in the case of a hair trimming or brushing part such a warning is not needed.

BRIEF DESCRIPTION OF THE DRAWINGS

In the drawings, like reference numerals refer to like elements.

DETAILED DESCRIPTION OF EMBODIMENTS

Figure 2:
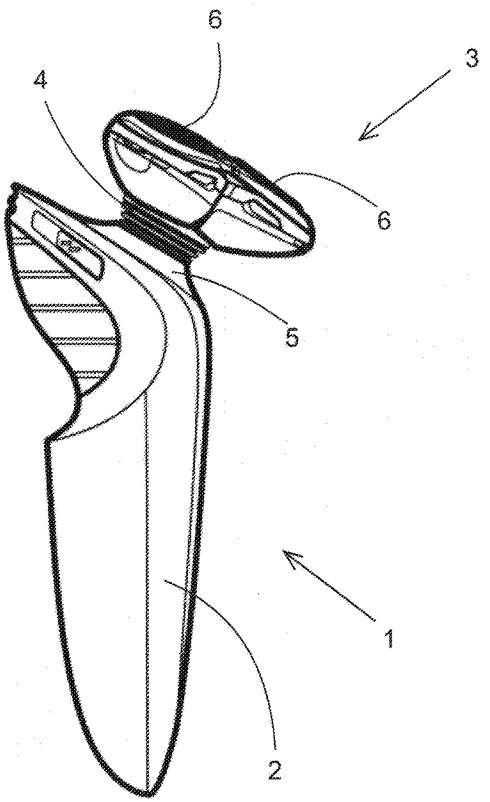
FIG. 2 is a side view of the personal care device according to the invention.
Figure 1:
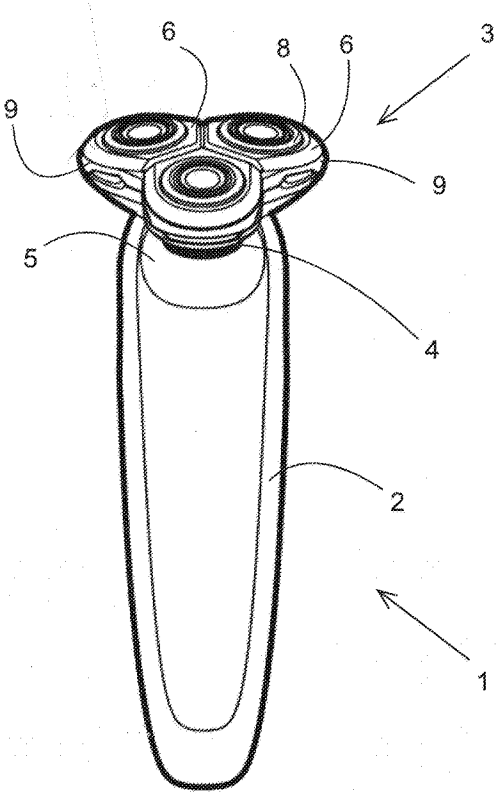
FIG. 1 is a perspective schematic view of a personal care device according to the invention.

FIGS. 1 and 2 show a personal care device according to the invention. The personal care device as shown in FIGS. 1 and 2 is a shaver 1 comprising a main housing 2, which is suitable to be held by a user of the shaver. In FIG. 1, for the sake of simplicity, the main housing 2 is only diagrammatically shown in view of the fact that within the scope of the present invention, the main housing 2 may have any suitable design. In FIG. 2 a possible design of the main housing 2 is shown. The shaver 1 further comprises a hair-cutting module 3, which is suitable to contact an area of skin having hairs to be shaved off and which can suitably be moved with respect to this area. The hair-cutting module 3 is connected to the main housing 2 through a central shaft member 4, wherein the connection of the hair-cutting module 3 to the main housing 2 may be detachable. Cross-sectional dimensions of the central shaft member 4 are considerably smaller than the cross-sectional dimensions of the hair-cutting module 3, and the hair-cutting module 3 is positioned at a certain distance from a top portion 5 of the main housing 2. Consequently, the connection between the main housing 2 and the hair-cutting module 3 has a slim appearance, wherein the hair-cutting module 3 has an elevated position with respect to the main housing 2. Due to this, when a user performs a shaving action by using the shaver 1, he may have a clear side view of the hair-cutting module 3.

The hair-cutting module 3 comprises three cutting units 6, which are arranged in a triangle formation. Within the scope of the present invention, the number of cutting units 6 may also be two or more than three. For the sake of completeness, it is noted that each of the cutting units 6 may be arranged so as to be movable to a certain extent to facilitate each of them in following a contour of an area of skin to be shaved. For example, the cutting units 6 may be pivotable, to a limited extent, with respect to the central shaft member 4. Each cutting unit 6 comprises a cap-shaped external cutting element 7 which is arranged at a top side of the cutting unit 6, and which has a plurality of openings 8 for letting through hairs to be shaved off. The cap-shaped external cutting element 7 is pivotably connected to a base portion 9 of the cutting unit 6. Right underneath the cap-shaped external cutting element 7, on the inside of the cutting unit 6, an internal cutting element (not visible) is rotatably arranged. During operation, a central portion of the internal cutting element is pressed against the cap-shaped external cutting element 7 under spring force.

The internal cutting elements of the cutting unit 6 are driven, via gear wheels, by a main driving axle extending from a motor in the main housing 2 through the central shaft member 4 into the hair cutting module 3

The shaver 1 described so far is known from WO2011055323A1 and WO200810139A1, in the name of the current applicant.

Figure 3:
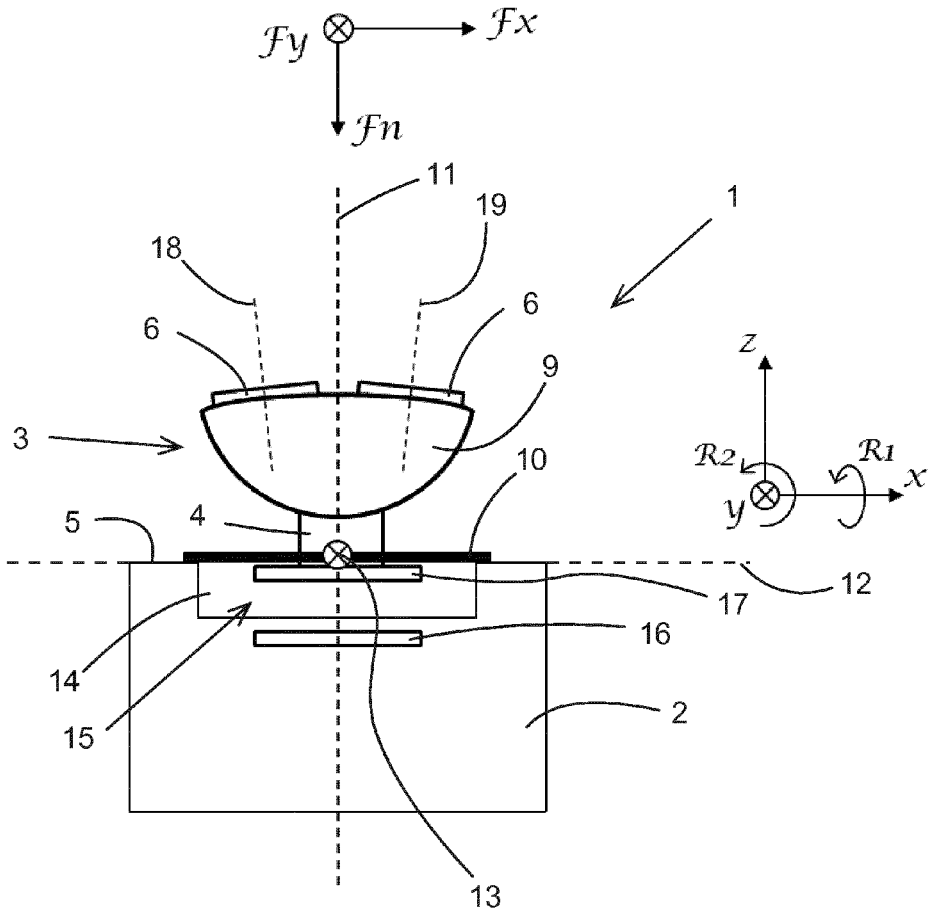
FIG. 3 is a schematic cross section of a first embodiment of the personal care device as shown in FIGS. 1 and 2.
Figure 4:
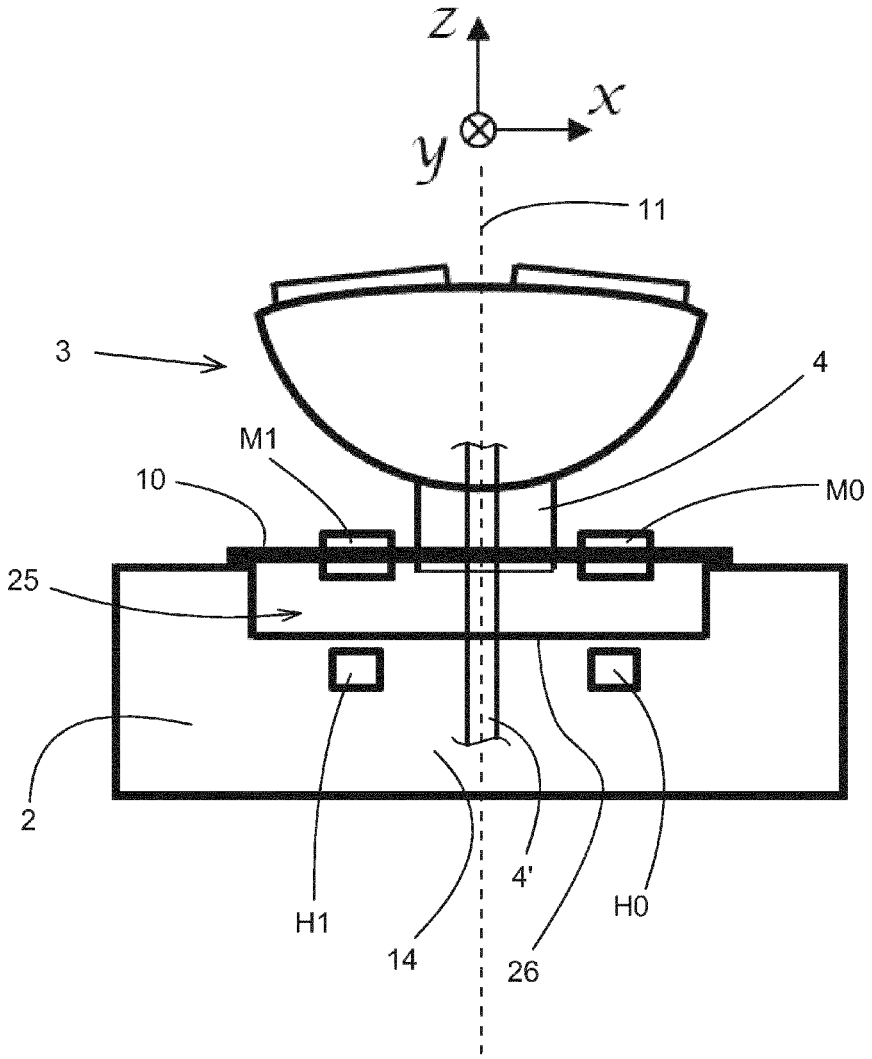
FIG. 4 is a schematic cross section of a second embodiment of the personal care device as shown in FIGS. 1 and 2, FIGS. 5 and 6 are detailed top and bottom views of the personal care device as shown in FIG. 4, FIGS. 7A and 7B are schematic top and side views of the sensor of the personal care device as shown in FIG. 4.
Figure 5:
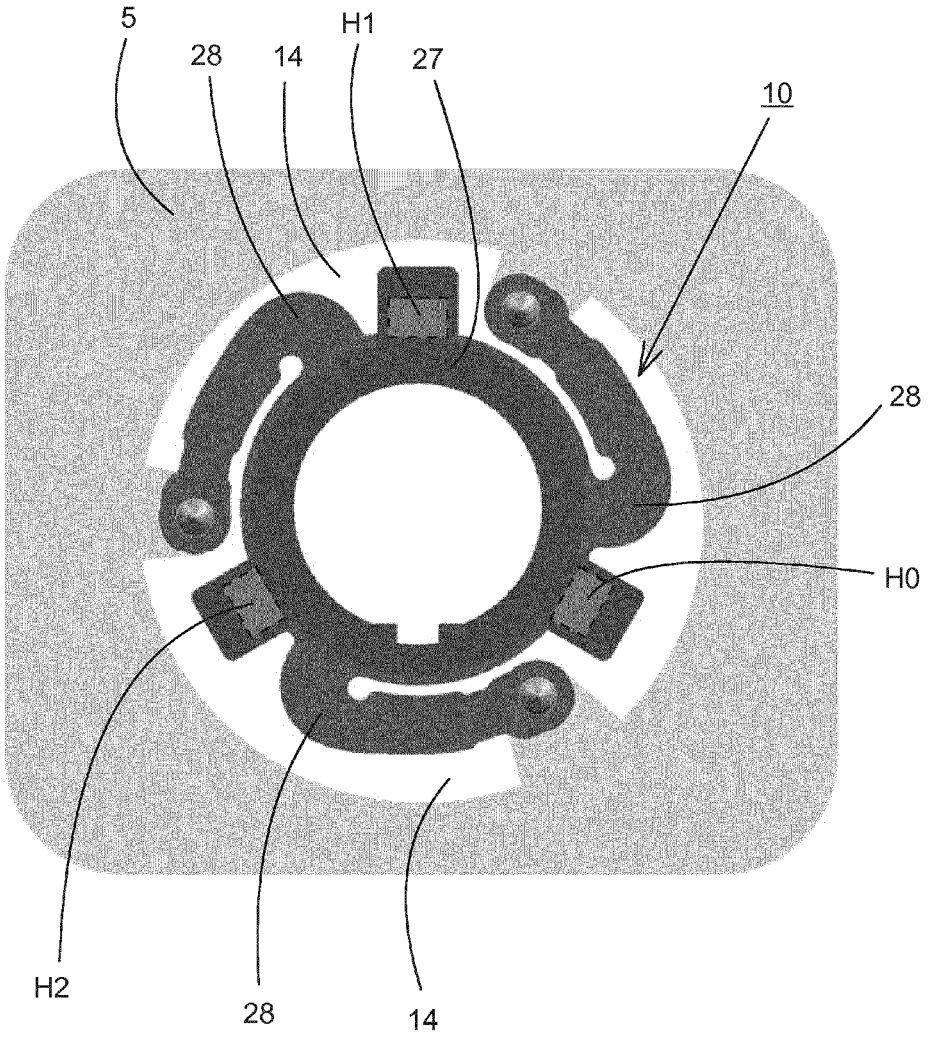
Figure 6:
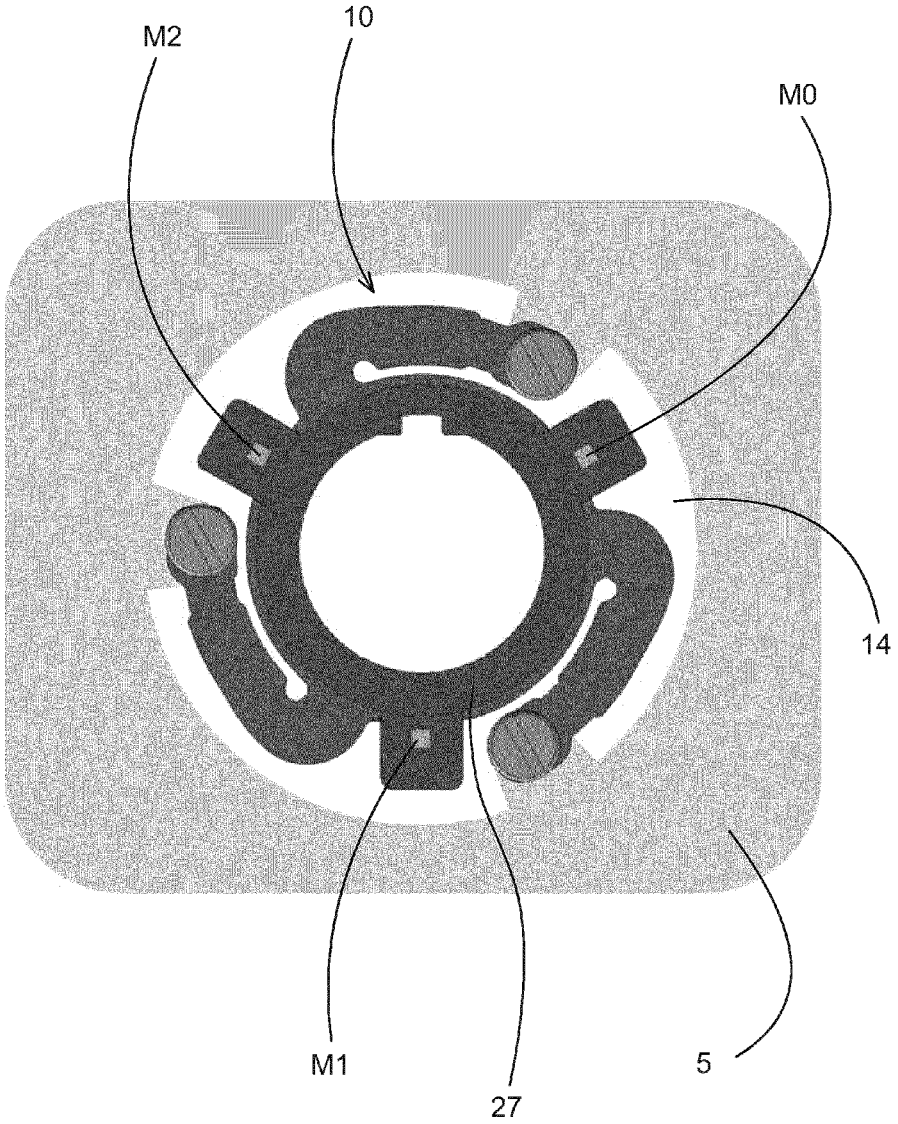

FIG. 3 is a schematic cross section of a first embodiment of the shaver 1. The central shaft member 4 of the hair-cutting module 3 is connected to the main housing 2 by means of a spring 10. The central shaft 4 extends parallel to a main axis 11. The main axis 11 extends in Z-direction. Due to the spring 10, the hair-cutting module 3 is displaceable with respect to the main housing 2 against spring force of the spring 10 along the main axis 11. Furthermore, due to the spring 10, the hair-cutting module 3 is displaceable with respect to the main housing 2 against spring force of the spring 10 in tilt directions R1, R2 about two tilt axes 12, 13. The tilt axes 12, 13 extend in X-direction and Y-direction, respectively. The X, Y, Z-directions extend perpendicularly to each other. By displacing the hair-cutting module 3 with respect to the main housing 2, the central shaft member 4 of the hair-cutting module 3 is partly moved into a space 14 of the main housing 2. The spring 10 is preferably stiff along the X-axis, along the Y-axis and in a pivot direction about the Z-axis.

The shaver 1 according to the invention comprises a sensor 15 located between the main housing 2 and the hair-cutting module 3. The sensor 15 comprises a cylindrical-shaped first sensor unit 16 connected to the main housing 2 and a cylindrical-shaped second sensor unit 17 connected to the hair-cutting module 3. The sensor units 16, 17 are located symmetrically around the main axis 11.

Due to this shape of the sensor units 16, 17, each location of the first sensor unit 16 with respect to the main housing 2 is located adjacent and opposite a location of the second sensor unit 17 with respect to the hair cutting module 3.

Due to this shape of the sensor units 16, 17, the first sensor unit 16 as well as the second sensor unit 17 are partly located on a left side of a first plane extending through the Y-Z-axes and are partly located in the right side of said first plane. The first plane extends perpendicularly to the plane of FIG. 3.

Due to this shape of the sensor units 16, 17, the first sensor unit 16 as well as the second sensor unit 17 are also partly located on a front side of a second plane extending through the X-Z-axes and are partly located in the back side of said second plane. The second plane extends parallel to the plane of FIG. 3.

The internal cutting elements of the cutting units 6 of the hair-cutting module 3 are rotatable with respect to the cap-shaped external cutting elements 7 about rotation axes 18, 19 with respect to the external cutting element. A third rotation axis is located behind the main axis 11. The three rotation axes are located symmetrically around the main axis 11, wherein the three rotation axes extend at an angle between 0 degrees and 15 degrees with respect to the main axis 11.

During shaving using the shaver 1, the user presses the cutting units 6 against the skin with a certain force, whereby the skin presses against the hair-cutting module 3 with a normal force Fn. Due to said normal force Fn extending perpendicularly to the skin and forces Fx, Fy extending parallel to the skin and being caused by friction between the cutting units 6 and the skin when the cutting units 6 are moved over the skin, the hair-cutting module 3 is being moved against the spring force of the spring 10 in axial direction and in the tilt directions R1, R2.

The sensor 15 measures the average displacement of the hair-cutting module 3 at multiple locations, each at a fixed radial distance from the main axis 11. By measuring this average displacement, the sensor 15 is only sensitive to displacement in the Z-direction, while rotations about the X- and Y-axes are cancelled out.

There is a direct relationship between the force Fn due to which the cutting module 3 is depressed against spring force of the spring 10 relative to the main housing 2 and the axial displacement. From the measured displacements and the known stiffness properties of the spring 10, the normal force Fn on the skin can be calculated by means of a processor (not shown). If the axial displacement and thus the normal force Fn is larger than a predetermined value, a warning signal will be produced by an alarm (not shown) located in the main housing 2.

FIGS. 4-7B show a second embodiment of the shaver 1. The shaver 1 differs from the shaver as shown in FIG. 3 by the configuration of the sensor only. The sensor 25 of the shaver 1 as shown in the FIGS. 4-7B comprises a first sensor unit with at least three Hall-sensor units H0, H1, H2 located at regular intervals around the main axis 11 and at the same radial distance from the main axis 11. The three Hall-sensor units H0, H1, H2 are mounted at a distance from the spring 10 on a bottom 26 of the space 14. The sensor 25 also comprises a second sensor unit with three magnets M0, M1, M2, each magnet M0, M1, M2 being located opposite one of the three Hall-sensor units H0, H1, H2. The three magnets M0, M1, M2 are mounted on a ring 27 connected to the central shaft member 4 of the hair-cutting module 3. The Hall-sensor units H0, H1 are located at first and second locations adjacent to and opposite magnets M0, M1 located at third and fourth locations, whilst the third Hall-sensor unit H2 and third magnet M2 are located at fifth and sixth locations, respectively. The spring 10 comprises three spring parts 28 connected with one end to the main housing 2 and with another end to the ring 27. Through a central opening 29 of the ring 27, a driving axle 4' for driving the rotation axes of the cutting units 6 extends. The driving axle 4' is located inside the central shaft member 4.

If the shaver 1 is not being used, the magnets M0, M1, M2 are situated in a plane extending parallel to a plane wherein the Hall-sensor units H0, H1, H2 are situated.

Figure 7A:
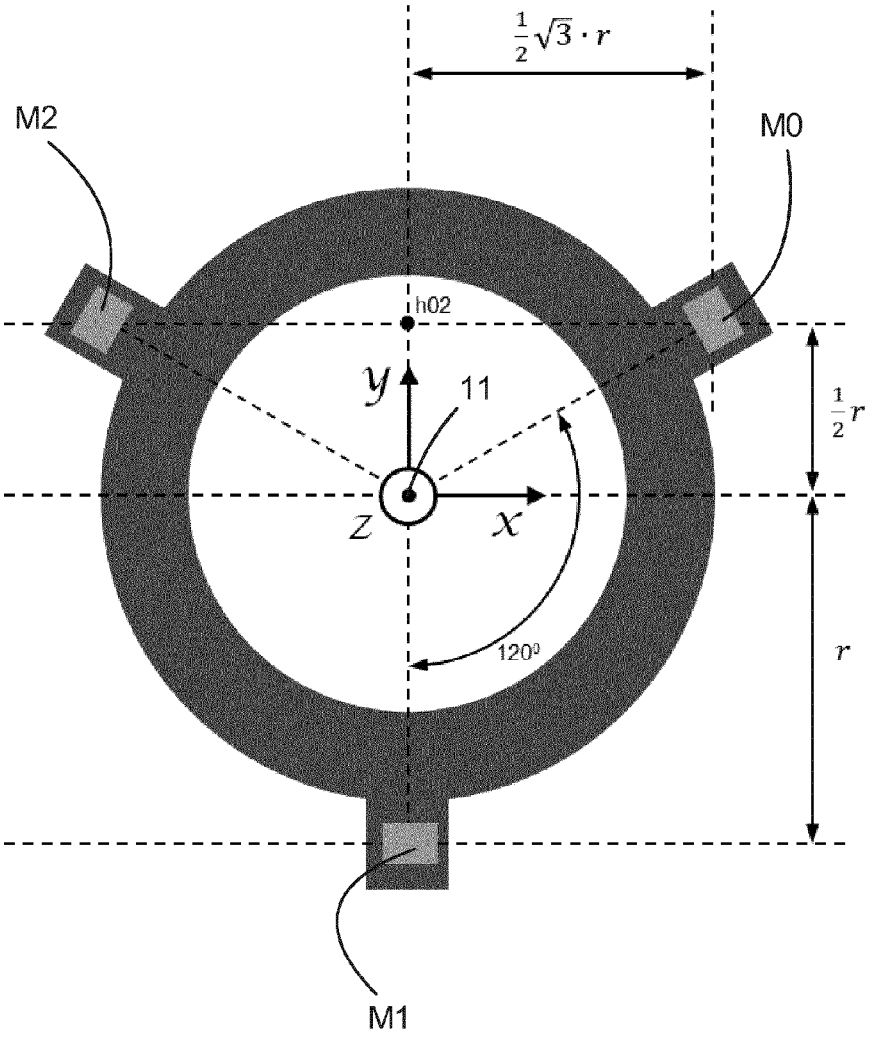
Figure 7B:
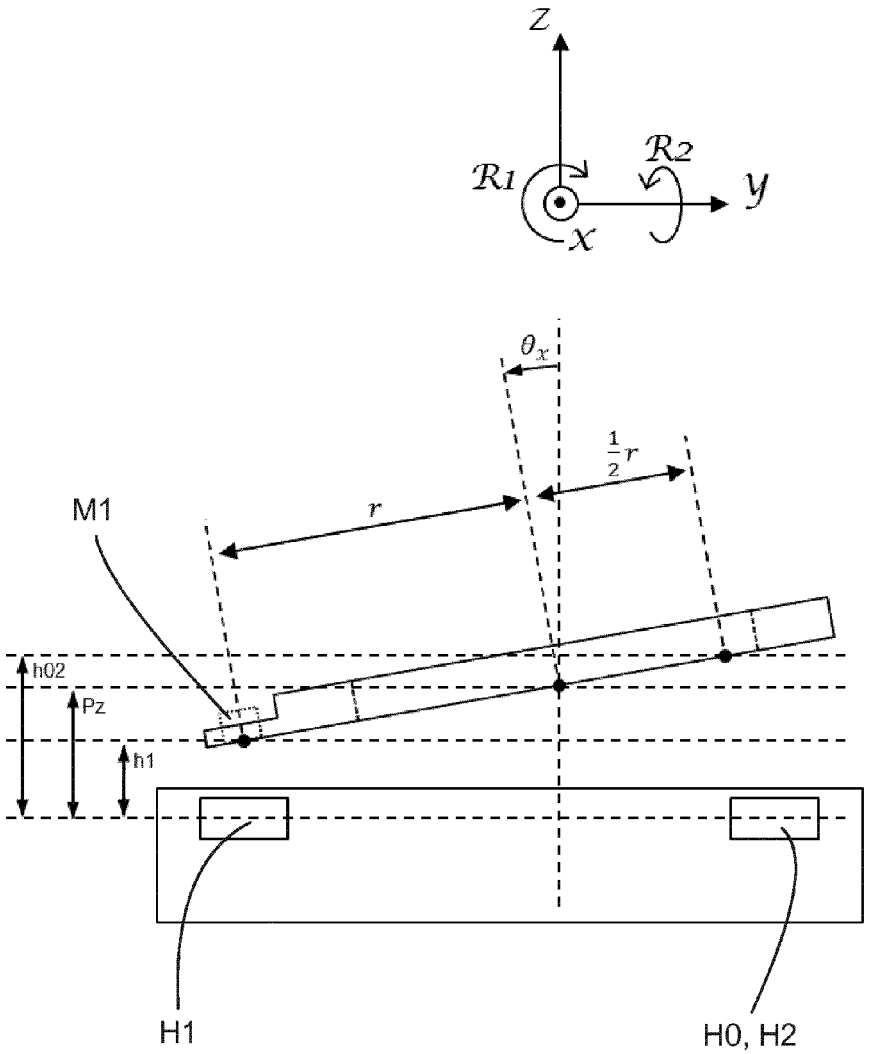
Figure 8:
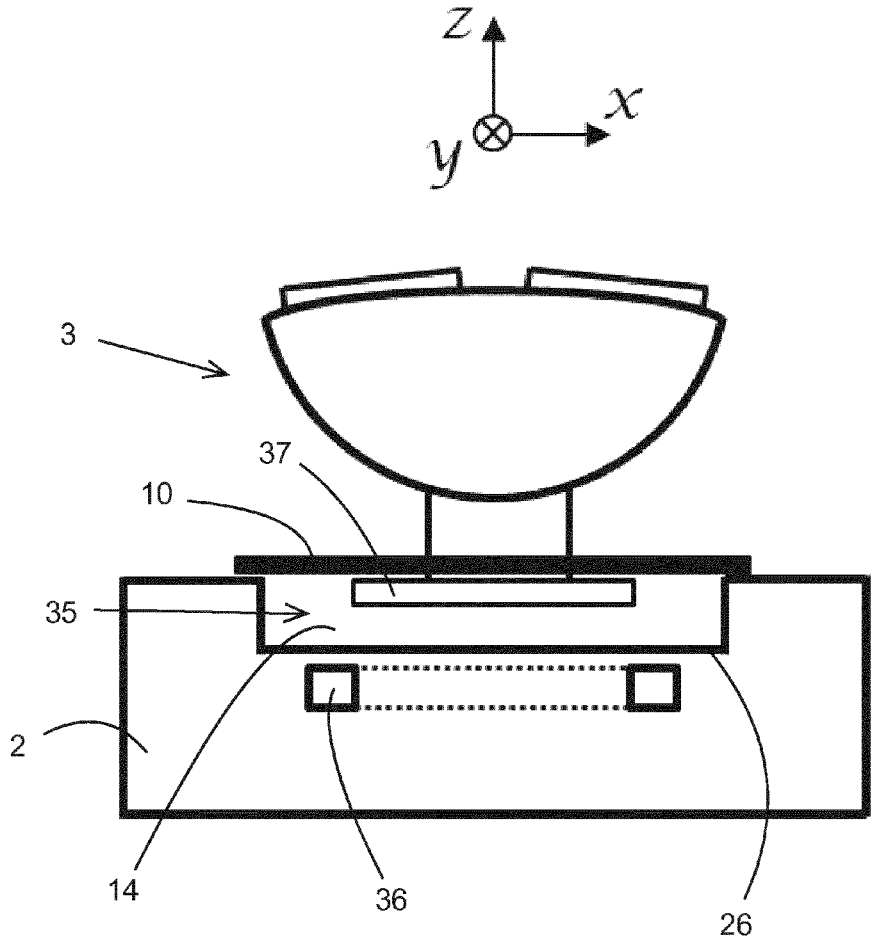
FIG. 8 is a schematic cross section of a third embodiment of the personal care device as shown in FIGS. 1 and 2, FIGS. 9-11 are views of the personal care device as shown in FIG. 8, obtained following respectively an axial displacement, tilt displacement and combined axial and tilt displacement of the hair-cutting module with respect to the main housing.

As can be seen in FIG. 7A, the magnet M0 and the Hall-sensor unit H0 are located on the right side of a plane through the Y-Z-axis, the magnet M1 and the Hall-sensor unit H1 are located in the plane through the Y-Z-axis, whilst the magnet M2 and the Hall-sensor unit H2 are located on the left side of the plane through the Y-Z-axis. Furthermore, the magnets M0, M2 and the Hall-sensor unit H0, H2 are located above a plane through the X-Z-axis, whilst the magnet M1 and the Hall-sensor unit H1 are located below the plane through the X-Z-axis. Due to said specific location of the magnets M0, M1, M2 and the Hall-sensor units H0, H1, H2, the exact displacement of the hair-cutting module 3 in the R1, R2, Z-directions can be measured, as will be explained below.

The magnets M0, M1, M2 and the Hall-sensor units H0, H1, H2 are located 120 degrees from each other.

By each combination of one of the magnets M0, M1, M2 and one of the Hall-sensor units H0, H1, H2, the distances between the first and third location, the second and fourth location and the fifth and sixth location are measured. The measured distance between the third location of the magnet M0 and the first location of the Hall-sensor unit H0 is h0, the measured distance between the fourth location of the magnet M1 and the second location of the Hall-sensor unit H1 is h1 and the measured distance between the sixth location of the magnet M2 and the fifth location of the Hall-sensor unit H2 is h2.

From the measured distances h0, h1, h2, the radius r and the angle of 120 degrees, the displacement Pz of the centre C of the hair-cutting module 3 can be calculated as follows:

$h02=(h0+h2)/2$; average distance of the magnets $M0$ and $M2$ to the Hall-sensor units $H0$ and $H2$ $$Pz=(h0+h1+h2)/3$$

$$\Theta X=\arcsin((Pz-h1)/r)$$

$$\Theta Y=\arcsin((h2-h0)/(r*\sqrt{3}))$$

The stiffness properties of the spring 10 are known, so that based on the known stiffness properties cz of the spring 10 and the value of the displacement Pz, the normal force Fn can be calculated Fn=cz*Pz.

If the normal force Fn is larger than a predetermined value a warning signal will be given.

In the same manner, based on known stiffness properties cx, cy of the spring 10 against rotation about the x-axis and y-axis respectively, the forces Fx and Fy can be calculated Fx=cx·ΘX and Fy=cy·ΘY. If the forces Fx, Fy are larger than a predetermined value, another warning signal will be given. In such a case, the user will be advised to use a gel to reduce the friction forces Fx, Fy.

FIGS. 8-11 show a third embodiment of the shaver 1. The shaver 1 differs from the shavers as shown in FIGS. 3 and 4-7B by the configuration of the sensor only. The sensor 35 of the shaver as shown in FIGS. 8-11 comprises a first sensor unit with a ring-shaped coil 36 located symmetrically about the main axis 11. The ring-shaped coil 36 is mounted at a distance from the spring 10 on the bottom 26 of the space 14. The sensor 35 also comprises a second sensor unit with a ring-shaped metal plate 37 located symmetrically about the main axis 11. The metal plate functions like a short-circuited coil with only one winding. The ring-shaped metal plate 37 is connected to the central shaft member 4 of the hair-cutting module 3.

Movement of the metal plate 37 with respect to the coil 36 influences the inductance of the coil 36.

Figure 9:
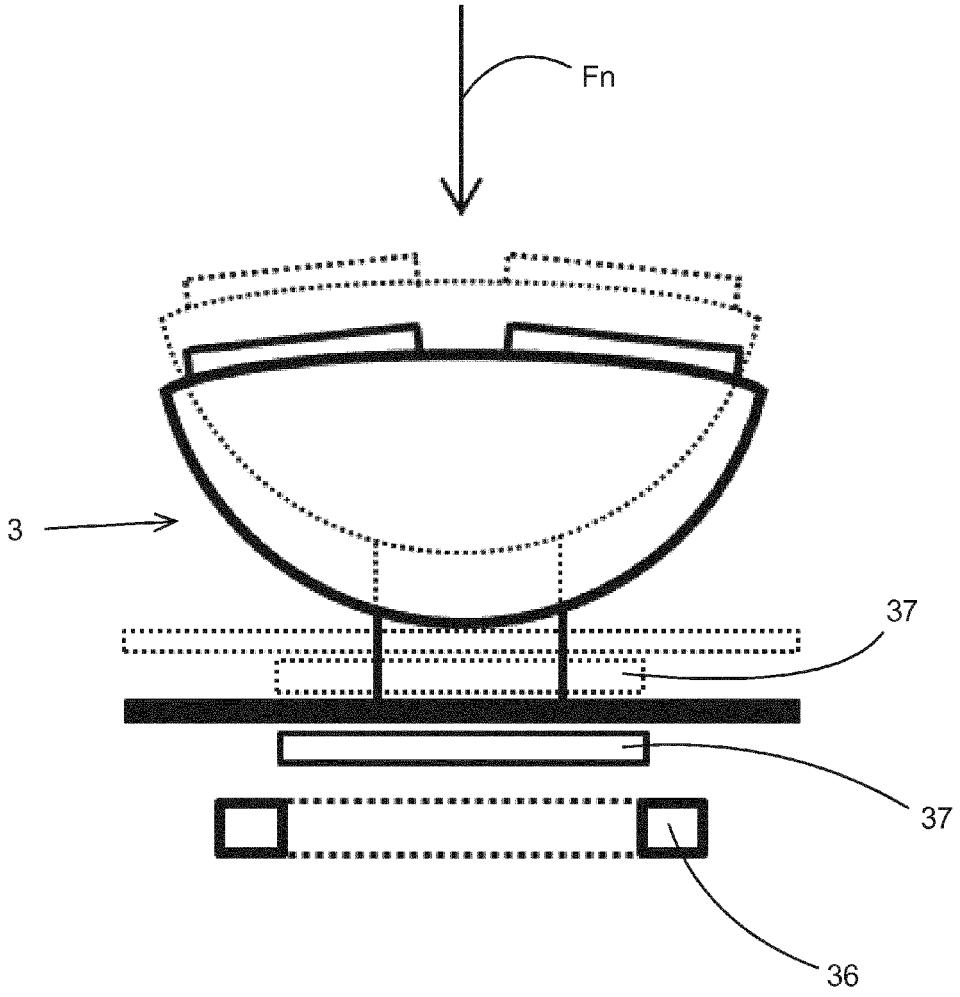

If the hair-cutting module 3 is only displaced along the main axis 11, as shown in FIG. 9, the hair-cutting module 3 is moved from the position as shown in dotted lines to the position shown in full lines. Along the complete circumference of the coil, the partial contribution to the coil inductance will change in the same manner. The change in inductance of the coil 36 is a measure of the displacement of the hair-cutting module 3 and thus of the force Fn.

Figure 10:
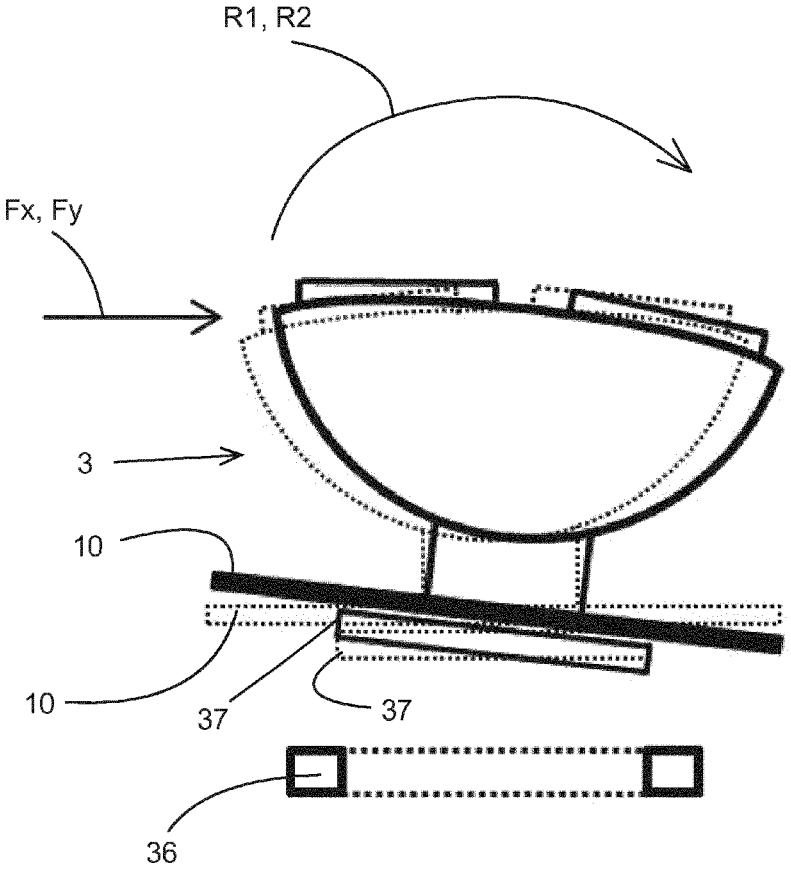

If the hair-cutting module 3 is only tilted about an axis extending perpendicularly to the main axis 11, as shown in FIG. 10, the hair-cutting module 3 is moved from the position as shown in dotted lines to the position shown in full lines. On the left side of FIG. 10, the distance between the coil 36 and the plate 37 will increase, whilst on the right side of FIG. 10, the distance between the coil 36 and the plate 37 will decrease. However, the average distance between the coil 36 and the plate 37 will remain the same, so the inductance of the coil 36 will not be changed.

Figure 11:
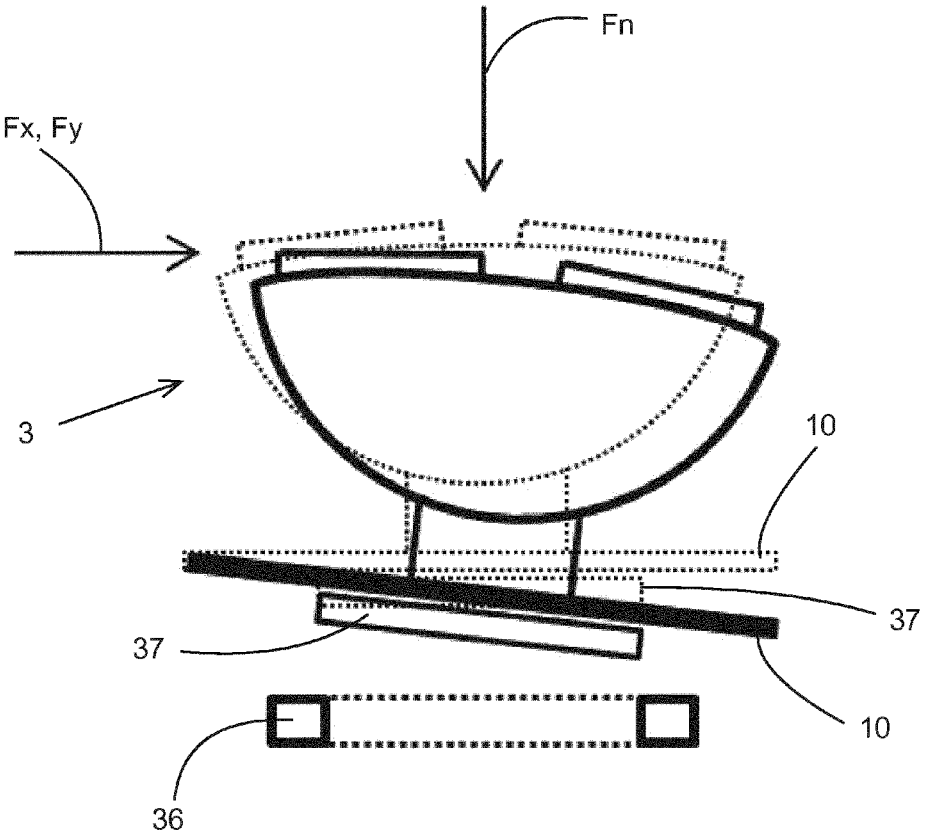

If the hair-cutting module 3 is displaced along the main axis 11 as well as tilted about an axis extending perpendicularly to the main axis 11, as shown in FIG. 11, the hair-cutting module 3 is moved from the position as shown in dotted lines to the position shown in full lines.

The change in inductance of the coil 36 will only be caused due to the displacement along the main axis 11.

It is also possible to use a plate of an electrically isolating material with a high magnetic permeability. Therefore, the plate can be made of ferrite. Also such a plate will influence the inductance of the coil 36.

The sensors as described above have the advantages that: the sensor has a very low cost;

the sensor can be placed inside the shaver such that no wires to the outside of the shaver are needed. This improves the water tightness of the shaver;

the sensor can measure static displacements because it has a low drift over time;

the sensor has a very long lifetime since it is not mechanically coupled, and hence it is free of wear.

Figure 12:
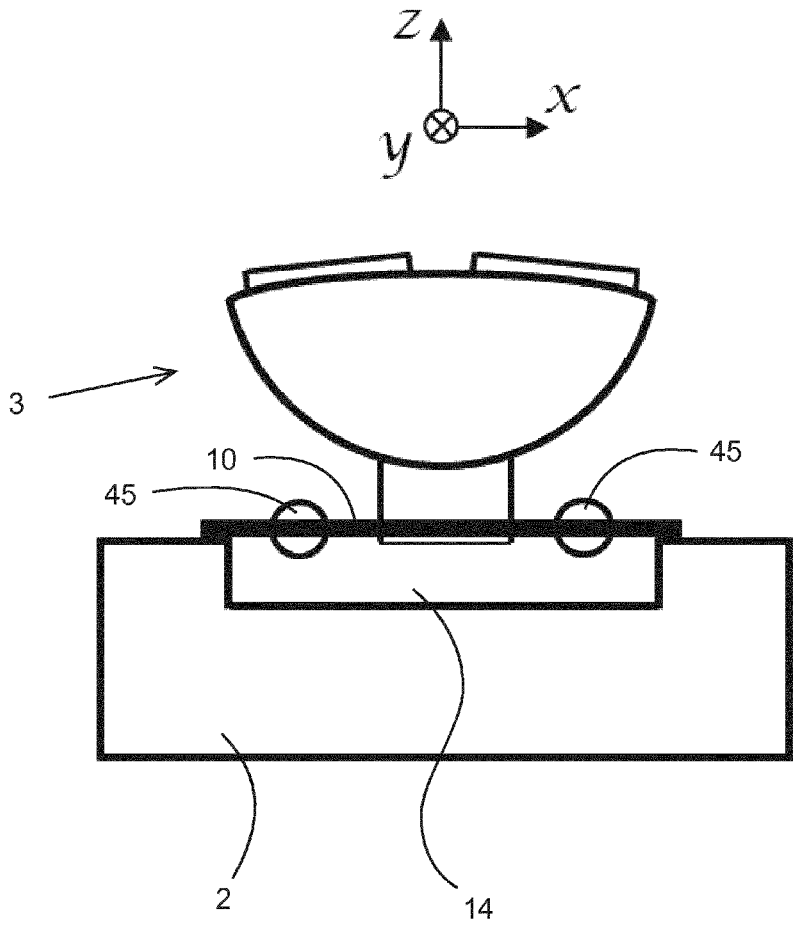
FIG. 12 is a schematic cross section of a fourth embodiment of the personal care device as shown in FIGS. 1 and 2.

FIG. 12 shows a fourth embodiment of the shaver 1. The shaver 1 differs from the shavers as shown in FIGS. 3, 4-7B and 8-11 by the configuration of the sensor only. The sensor 45 is suitable for the measurement of the average displacement Pz of the hair-cutting module 3 along the main axis 11, wherein the sensor is located at a distance from the main axis 11 to be able to allow a driving axle, used for driving the rotation axes of the cutting units, to extend centrally through the sensor. Such a sensor 45 may comprise for example piezo-elements, force-sensitive resistors, capacitive distance sensors or strain gauges.

It is also possible that magnets M0, M1, M2 are connected to the main housing and the Hall-sensor units H0, H1, H2 are connected to the hair-cutting module 3.

It is also possible that the hair-cutting module 3 is only tiltable about one single tilt axis.

Figure 13:
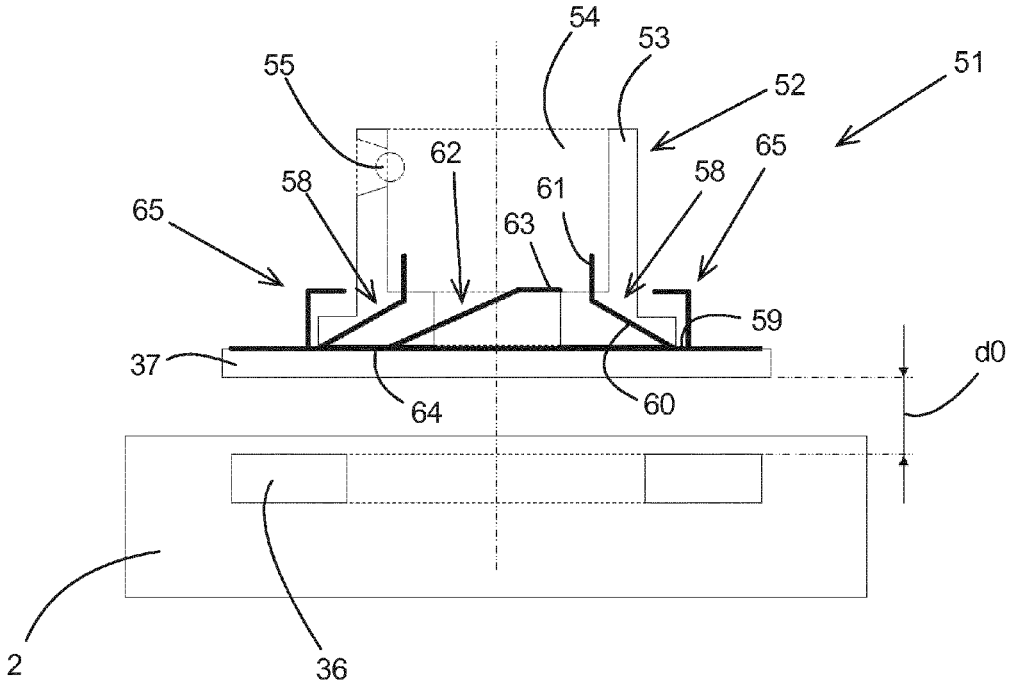
FIG. 13 is a schematic cross section of a fifth embodiment of the personal care device as shown in FIGS. 1 and 2, without a hair cutting part.
Figure 14:
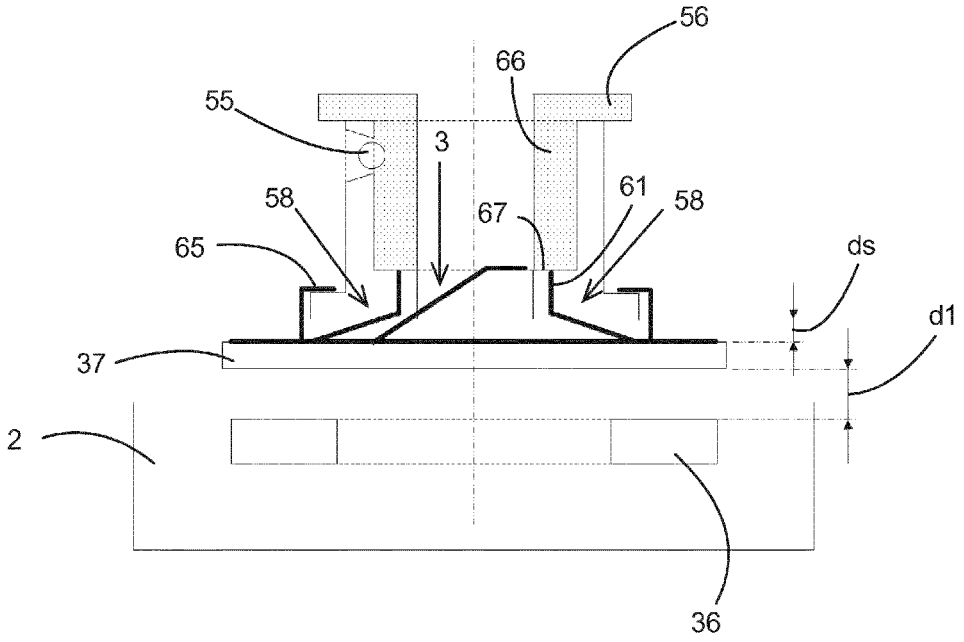
FIG. 14 is a schematic cross section of the personal care device as shown in FIG. 13, with a first hair cutting part.
Figure 15:
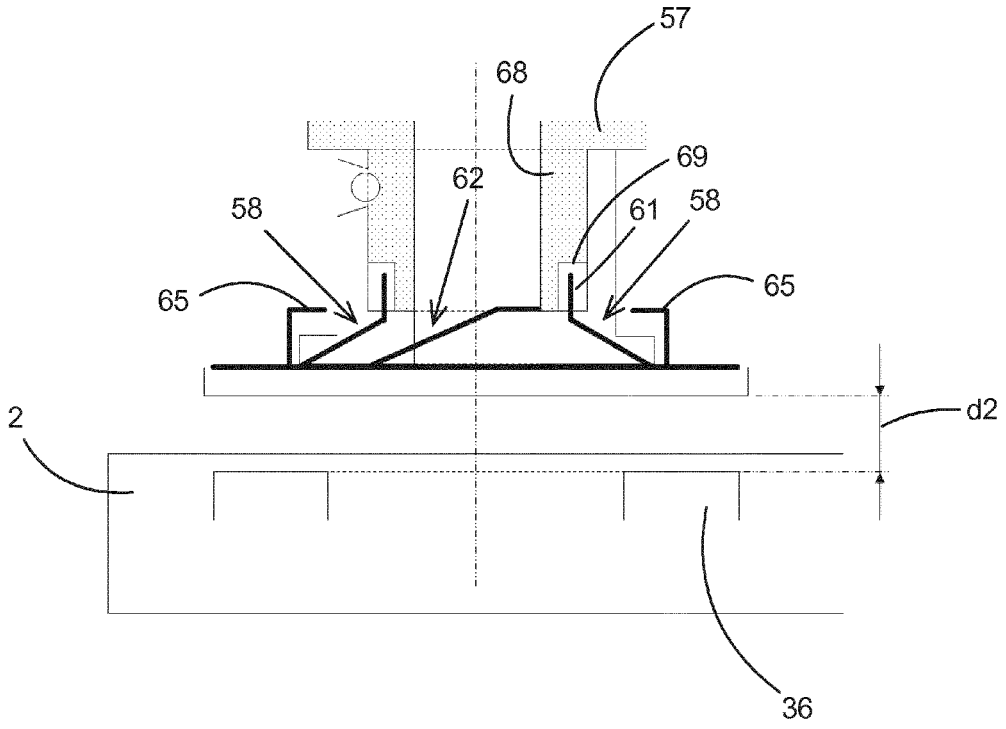
FIG. 15 is a schematic cross section of the personal care device as shown in FIG. 13, with a second hair cutting part.

FIGS. 13-15 show a fifth embodiment of the personal care device 51 according to the invention. The personal care device differs from the shaver 1 as shown in FIGS. 8-11 by the configuration of the hair-cutting module 3. Like the shaver 1 as shown in FIGS. 8-11, the sensor 35 of the personal care device 51 comprises a first sensor unit with a ring-shaped coil 36 located symmetrically about the main axis 11. The sensor 35 also comprises a second sensor unit with a ring-shaped metal plate 37 located symmetrically about the main axis 11. The metal plate functions like a short-circuited coil with only one winding. Movement of the metal plate 37 with respect to the coil 36 influences the inductance of the coil 36. In the position as shown in FIG. 13, the metal plate 37 is located at a distance d0 from the coil 36. The personal care device 51 differs from the shaver 1 as shown in FIGS. 8-11 in that the hair-cutting module 3 comprises an intermediate part 52 with a tubular housing 53, a central opening 54 in the housing 53 and an element 55 being able to hold a hair cutting part 56, 57 in the opening 54. The intermediate part 52 also comprises a number of first springs 58. Each spring 58 comprises a horizontally extending part 59 connected to the metal plate 37, an inclined part 60 connected to the horizontally extending part 59 and a vertically extending part 61 connected to the inclined part 60. The vertically extending part 61 can slide in a direction parallel to the main axis 11 with respect to the housing 53.

The intermediate part 52 also comprises a number of second springs 62 connected with one end 63 to the tubular housing 53 and with another end 64 to the metal plate 37. The second springs 62 pull the metal plate 37 against the tubular housing 53. The cumulative stiffness of the second springs 62 is less than the cumulative stiffness of the first springs 58. Furthermore, the intermediate part 52 comprises hook-shaped stopping elements 65 limiting the movement of the metal plate 37 in a direction away from the tubular housing 53.

FIG. 14 shows the personal care device 51 with a first hair cutting part 56 being detachably connected to the intermediate part 52. The first hair cutting part 56 may comprise a base portion 9 and cutting units 6 (not shown in FIG. 14), like the shaver 1 as shown in FIGS. 1 and 2. The hair cutting part 56 comprises a tubular part 66 having an end portion 67. When the tubular part 66 of the first hair cutting part 56 is inserted into the opening 54 of the intermediate part 52, it is kept in this position by means of element 55. The element 55 may comprise a spring being able to firmly hold the tubular part 62 but allowing detaching of the first hair cutting part 56 when a user firmly pulls at the first hair cutting part 56. Such a connection is known in personal care devices and will not be further explained. When the tubular part 62 of the first hair cutting part 56 is inserted into the opening 54 of the intermediate part 52, the end portion 67 will be pressed against the vertically extending parts 61 of the springs 58, due to which forces the vertically extending parts 61 of the springs 58 will be moved in a direction parallel to the main axis 11 and will move the metal plate 37 towards the coil 36 over a distance ds. This position of the metal plate 37 is the first reference position and when the personal care device 51 is in use, the metal plate 37 will be moved further towards the coil 36 when the cutting units 6 are pressed against the skin of a user.

FIG. 15 shows the personal care device 51 with a second hair cutting part 57 being detachably connected to the intermediate part 52. The second hair cutting part 57 may comprise a trimmer or brush (not shown in FIG. 15). The hair cutting part 57 comprises a tubular part 68 having an end portion 69. The tubular part 68 of the second hair cutting part 57 is connected to the intermediate part 52 in the same manner as the tubular part 66 of the first hair cutting part 56. However, when the tubular part 68 of the second hair cutting part 57 is inserted into the opening 54 of the intermediate part 52, the end portion 69 will be located at a distance d2 from the vertically extending parts 61 of the springs 58 and will not be pressed against the vertically extending parts 61 of the springs 58. The distance d2 between the metal plate 37 and the coil 36 is the same as the distance d0 in FIG. 13, wherein no hair cutting part is connected to the intermediate part 52. This position of the metal plate 37 is the second reference position and when the personal care device 51 is in use, the metal plate 37 will be moved further towards the coil 36 when the personal care device is pressed against the skin of a user.

Figure 16:
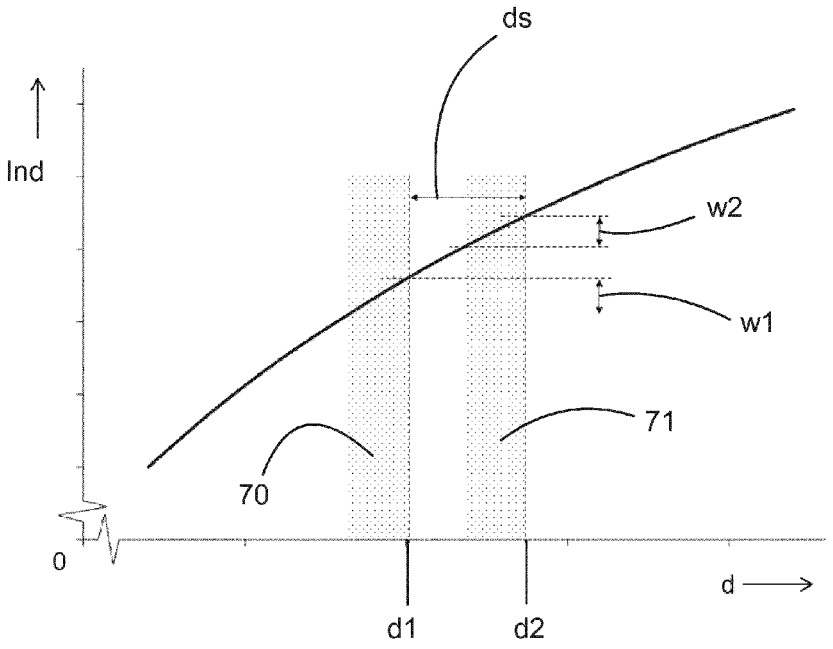
FIG. 16 is a graph showing the operating windows of the sensor of the personal care device as shown in FIG. 13, with the first and the second hair cutting part.

FIG. 16 shows a graph in which the distance d between the metal plate 37 and the coil 36 is plotted on the x-axis and the corresponding value for the inductance is plotted on the y-axis. In this graph, the first reference position is at a distance d1, which is smaller than the distance d2 of the second reference position. When the personal care device 51 is in use, the distance d will vary in the grey area 70, 71, respectively.

The respective inductance values will vary over an operating window W1, W2 respectively.

By measuring the inductance it can be determined whether the first or the second hair cutting part 56, 57 is connected to the intermediate part 52.

The same change in operating window can also be achieved by means of an offset of the electric resistance of the metal plate 37, for example by an embodiment in which the metal plate 37 has a slot which is short-circuited when the first hair cutting part with a shaving unit is placed. The principle of changing the operating window of the sensor 35 can also be applied on other force-sensing principles e.g. hall sensor, strain gauge or piezo-based force sensors.

The personal care device can also be a vibratory shaver, a trimmer, a grooming device or other kind of cutting device.

The first, second, third and fourth locations can also be located on the same side of a plane through the main axis and tilt axis if the distance from the first location to the plane differs from the distance from the second location to the plane. The main feature is that the distance change due to the tilting movement is different between the first and third location and between the second and fourth location.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

Any reference signs in the claims should not be construed as limiting the scope of the claims.

LIST OF REFERENCE SIGNS

1 shaver
2 main housing
3 hair-cutting module
4 central shaft member
4' driving axle
5 top portion
6 cutting unit
7 external cutting element
8 opening
9 base portion
10 spring
11 main axis
12 tilt axis
13 tilt axis
14 space
15 sensor
16 first sensor unit
17 second sensor unit
18 rotation axis
19 rotation axis
25 sensor
26 bottom
27 ring
28 spring part
29 central opening
35 sensor
36 coil
37 metal plate
45 sensor
51 personal care device
52 intermediate part
53 tubular housing
54 central opening
55 element
56 hair cutting part
57 hair cutting part
58 first spring
59 horizontally extending part
60 inclined part
61 vertically extending part
62 second spring
63 end
64 end
65 tubular part
66 tubular part
67 end portion
68 tubular part
69 end portion
70 grey area
71 grey area
C centre
Fn force Fn
H0 Hall-sensor unit
H1 Hall-sensor unit
H2 Hall-sensor unit
M0 magnet
M1 magnet
M2 magnet
Pz displacement
r radius
R1 tilt direction R1
R2 tilt direction R2
W1 operating window
W2 operating window
Z direction
δ distance

The invention claimed is:

1. A personal care device comprising:

a main housing disposed around a main axis;

a hair-cutting module that is displaceable relative to the main housing in a direction parallel to the main axis;

a spring arrangement disposed in the device for applying a predetermined spring force against displacement of the hair-cutting module in said direction parallel to the main axis;

a sensor arrangement comprising a first sensor unit connected to the main housing and a second sensor unit connected to the hair-cutting module for movement with said module;

the hair-cutting module also being rotatable relative to the main housing about at least one tilt axis extending perpendicularly to the main axis and against said predetermined spring force;

the first sensor unit including first and second sensory portions disposed at respective first and second locations relative to the main housing;

the second sensor unit including third and fourth sensory portions disposed at respective third and fourth locations relative to the hair-cutting module that are opposite to the first and second locations, respectively;

said first and second sensor units being adapted to move relative to each other during tilting of the hair-cutting module about the at least one tilt axis such that distances between the first and third sensory portions and between the second and fourth sensory portions will change, but the average distances between the first and second sensor units will remain unchanged; and the sensor arrangement being adapted to be insensitive to said unchanging average distances during tilting but to be sensitive to said changes in displacement of the hair-cutting module relative to the main housing in the direction parallel to the main axis.

2. A personal care device according to claim 1 where, with respect to a plane extending through the main axis and the tilt axis, the first and the third location are located on a first side of said plane whilst the second and the fourth location are partly located in said plane or on a second side of said plane.

3. A personal care device according to claim 1 where the hair-cutting module is tiltable with respect to the main housing about two tilt axes extending perpendicularly to each other.

4. A personal care device according to claim 1 where the first sensor unit and the second sensor unit are arranged symmetrically around the main axis.

5. A personal care device according to claim 1 where the hair-cutting module comprises a number of cutting units, each cutting unit being provided with an external cutting element and an internal cutting element being rotatable about a rotation axis with respect to the external cutting element, wherein the rotation axes of the cutting units are located symmetrically around the main axis and each enclose an angle between 0 degrees and 15 degrees with the main axis.

6. A personal care device according to claim 5 where the hair-cutting module is connected to the main housing via a central shaft member which accommodates a main driving axle for commonly driving the internal cutting elements of the cutting units, and wherein the sensor arrangement is arranged symmetrically around said main driving axle.

7. A personal care device according to claim 1, wherein the first sensor unit or the second sensor unit comprises a ring-shaped coil and the other of the sensor units comprises a plate influencing a magnetic field of the ring-shaped coil by a displacement of the second sensor unit with respect to the first sensor unit in a direction parallel to the main axis.

8. A personal care device according to claim 1, wherein the first sensor unit or the second sensor unit comprises at least three Hall-sensor elements arranged at predetermined different locations around the main axis, and the other of the sensor units comprises at least three magnets, each magnet being arranged opposite a respective one of the Hall-sensor elements, seen in directions parallel to the main axis.

9. A personal care device according to claim 8, wherein the Hall-sensor elements as well as the magnets are arranged at regular intervals around the main axis.

10. A personal care device according to claim 1, wherein the hair cutting module comprises an intermediate part, which is provided with the second sensor unit, and a first hair cutting part, which is detachably connectable to the intermediate part, whilst the personal care device comprises a second hair cutting part which is different from the first hair cutting part, wherein by connecting the first hair cutting part to the intermediate part the second sensor unit is displaced into a reference position relative to the first sensor unit, or obtains a geometry or a material characteristic which is different from, respectively, a reference position, a geometry or a material characteristic obtained by connecting the second hair cutting part to the intermediate part.

11. A personal care device according to claim 10, wherein the second sensor unit is displaced against spring force with respect to the intermediate part by connecting the first hair cutting part to the intermediate part.

12. A personal care device according to claim 10, wherein the first hair cutting part is a hair shaving part and the second hair cutting part is a hair trimming or brushing part.

13. A personal care device according to claim 1 where a distance between the first and second locations is at least 25% of a distance between the first and the third locations.

* * * * *